US007658017B1

(12) United States Patent
Laviolette et al.

(10) Patent No.: US 7,658,017 B1
(45) Date of Patent: Feb. 9, 2010

(54) VACUUM DRYING METHOD

(76) Inventors: Thomas Brian Laviolette, 1001 Oakwood Rd., Ortonville, MI (US) 48462; Jessica Lynn Laviolette, 1001 Oakwood Rd., Ortonville, MI (US) 48462

( * ) Notice: Subject to any disclaimer, the term of this patent is extended or adjusted under 35 U.S.C. 154(b) by 1124 days.

(21) Appl. No.: 10/755,571

(22) Filed: Jan. 12, 2004

(51) Int. Cl.
*F26B 11/00* (2006.01)

(52) U.S. Cl. ..... 34/403

(58) Field of Classification Search ..... 34/380, 34/403, 92, 272
See application file for complete search history.

(56) References Cited

U.S. PATENT DOCUMENTS 1,534,738 A * 4/1925 Roe ..... 34/423
1,606,442 A * 11/1926 Nichols ..... 34/230
1,705,084 A * 3/1929 Draper ..... 427/234
2,049,711 A * 8/1936 Lundy ..... 34/498
2,108,017 A * 2/1938 Lithgow ..... 427/239
2,116,884 A * 5/1938 Fisher ..... 106/310
2,346,764 A * 4/1944 Kratz ..... 264/212
2,498,339 A * 2/1950 Miskella ..... 118/642
2,729,450 A * 1/1956 Clapham ..... 473/122
2,777,782 A * 1/1957 Sheffer et al. ..... 427/318
3,099,540 A * 7/1963 Eisler ..... 34/245
3,228,113 A * 1/1966 Fannon, Jr. ..... 34/308
3,237,314 A * 3/1966 Smith, Jr. ..... 34/266
3,257,732 A * 6/1966 Webster ..... 34/318
3,286,369 A * 11/1966 Smith, Jr. ..... 34/278
3,346,417 A * 10/1967 Ehrlich ..... 75/403
3,400,465 A * 9/1968 Von Stroh ..... 34/443
3,401,466 A * 9/1968 Brewster ..... 34/92
3,456,357 A * 7/1969 Griffith ..... 34/401
3,574,949 A * 4/1971 Farnsworth ..... 34/407
3,803,111 A * 4/1974 Munro et al. ..... 34/372
4,125,366 A * 11/1978 Boyer ..... 432/209
4,136,463 A * 1/1979 Nolan et al. ..... 34/272
4,370,534 A * 1/1983 Brandon ..... 219/695
4,546,553 A * 10/1985 Best ..... 34/266
4,621,187 A * 11/1986 Petro, Jr. ..... 392/414
4,761,894 A * 8/1988 Hamasaki et al. ..... 34/270
4,785,552 A * 11/1988 Best ..... 34/418
4,980,030 A * 12/1990 Johnson et al. ..... 203/4
5,003,143 A * 3/1991 Marks et al. ..... 219/685
5,095,811 A * 3/1992 Shutic et al. ..... 454/52
5,113,600 A * 5/1992 Telchuk ..... 34/90
5,134,787 A * 8/1992 Sprenger ..... 34/414
5,147,422 A * 9/1992 Neeley et al. ..... 95/210
5,229,010 A * 7/1993 Fluchel ..... 210/748
5,230,161 A * 7/1993 Best ..... 34/267
5,282,145 A * 1/1994 Lipson et al. ..... 700/208
5,363,567 A * 11/1994 Best ..... 34/271
5,397,606 A * 3/1995 Jeffs ..... 427/542
5,398,425 A * 3/1995 Cherry et al. ..... 34/270
5,444,029 A * 8/1995 Martin ..... 502/38
5,548,907 A * 8/1996 Gourdine ..... 34/448
5,836,085 A * 11/1998 Ben-Ezra ..... 34/270
5,953,832 A * 9/1999 Rosynsky et al. ..... 34/403
6,071,558 A * 6/2000 Shutic ..... 427/180

(Continued)

*Primary Examiner*—Stephen M. Gravini
(74) *Attorney, Agent, or Firm*—Carlson, Gaskey & Olds

(57) ABSTRACT

A vacuum drying apparatus and method to dry and cure paint is disclosed. The method provides a substantially particle free environment that shortens drying time, reduces cost and improves surface finish. The apparatus includes an enclosed drying tunnel that is maintained at a reduced pressure relative to ambient conditions. Heat lamps with the drying tunnel aid in curing and provide the desired particle free environment.

6 Claims, 1 Drawing Sheet

U.S. PATENT DOCUMENTS 6,192,604 B1 * 2/2001 Morrison ..... 34/666
6,546,647 B2 * 4/2003 Speck ..... 34/468
6,644,092 B1 * 11/2003 Oppel ..... 73/1.61
6,990,749 B2 * 1/2006 Roesler et al. ..... 34/201
7,063,528 B2 * 6/2006 Klobucar et al. ..... 432/147
2007/0022625 A1 * 2/2007 DeRegge et al. ..... 34/275
2009/0007452 A1 * 1/2009 Cho ..... 34/265
2009/0017408 A1 * 1/2009 Pakkala et al. ..... 432/145
2009/0107002 A1 * 4/2009 Uhlyarik ..... 34/487

* cited by examiner

VACUUM DRYING METHOD

BACKGROUND OF THE INVENTION

This invention relates generally to the field of painting and more specifically to a method and device for drying and curing paint.

Automobile assembly plants use a clean room atmosphere for drying and curing paint applied to automotive components. Such clean room environments entail high maintenance and operational costs Further, such clean room drying processes still produce defects in the paint that require costly repairs in order to provide an acceptable level of quality.

Accordingly, it is desirable to develop an improved method and device for effectively drying and curing a coating applied to an article.

BRIEF SUMMARY OF THE INVENTION

An example method and device according to this invention includes an enclosure maintained at a desired vacuum pressure along for curing an applied coating such as paint.

The example method consists of drying a coating applied to a painted article, utilizing the steps of placing the painted article in an enclosure, controlling a first pressure within the enclosure such that the first pressure within the enclosure is lower than a second pressure outside the enclosure, and maintaining the first pressure within the enclosure to provide a desired condition of the coating applied to the painted article.

An example device according to this invention includes an enclosure with an inlet airlock and an outlet airlock. A painted article enters the inlet airlock and is sealed from an external environment. A vacuum is then generated within the inlet airlock that is equal to a vacuum pressure within the enclosure. Once the inlet airlock and the enclosure are of the same pressure, the painted article enters the enclosure and remains within the enclosure for a desired duration until the applied coating is cured as desired. The painted article is then removed through the outlet airlock back to ambient conditions.

The vacuum pressure within the enclosure removes undesirable particles and dust while also providing an environment that speeds the curing of the paint on the painted article.

Accordingly, the method and device according to this invention provides substantial improvements in paint quality and process efficiency.

Other objects and advantages of the present invention will become apparent from the following descriptions, taken in connection with the accompanying drawings, wherein, by way of illustration and example, an embodiment of the present invention is disclosed.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Detailed descriptions of an example embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually an appropriately detailed system, structure or manner.

Figure 1:
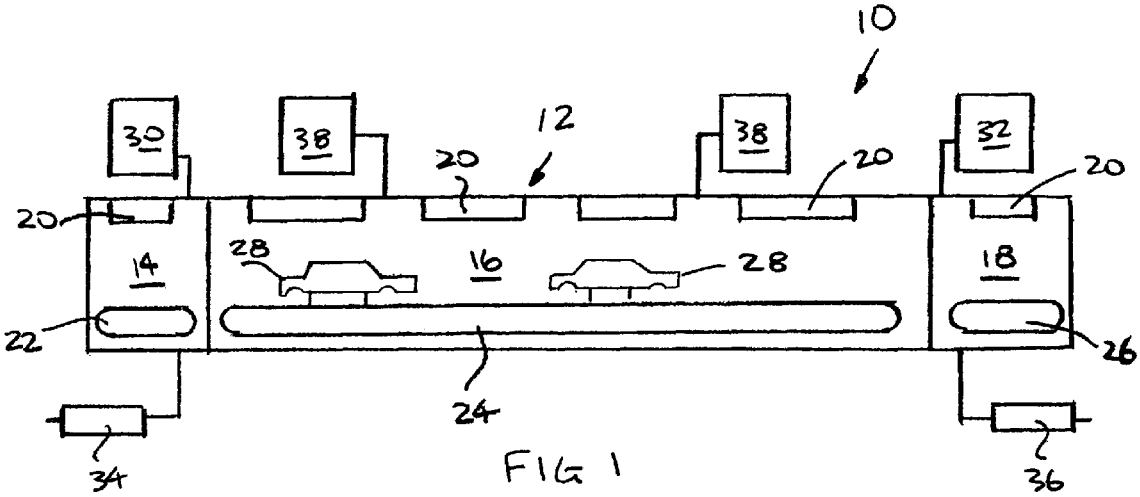
FIG. 1 is a schematic diagram illustrating the operation of a portion of the invention.

As shown in enclosed FIG. 1, an example vacuum paint drying apparatus 10 comprises a vacuum chamber 12 having an entry air lock 14, a drying tunnel 16 and an exit air lock 18. Radiant heat sources in the form of infrared or ultraviolet heat lamps 20 are arranged within the air locks 14 and 18, as well as along the drying tunnel 16. The air locks and drying tunnel 16 each have respective conveyors 22, 24 and 26 that transport items, such as automobile bodies 28, through the apparatus. Air locks 14 and 18 each include a high capacity vacuum pump 30 and 32, respectively, for rapidly pumping the air locks 14, 18 to a desired atmospheric pressure. The drying tunnel 16 includes a set of vacuum pumps 38 for maintaining a desired vacuum pressure within the drying tunnel 16.

In operation, the drying tunnel 16 is maintained below atmospheric pressure by vacuum pump sets schematically shown at 38 and the air locks 14 and 18 that isolate and seal the drying tunnel 16 from the ambient surrounding environment. The entry air lock 14 is initially at atmospheric pressure and open to the ambient surrounding environment. A freshly painted automobile body 28 enters the entry air lock 14 on conveyor 22, the air lock 14 is sealed from the ambient surrounding environment, the lamp 20 is turned on and the air lock 14 is pumped down to a desired pressure by the vacuum pump 30.

When the desired pressure in the entry air lock 14 is equal to the pressure in the drying tunnel 16, the air lock 14 is opened to the drying tunnel 16 and the automobile or other painted article is transferred from the conveyor 22 to the conveyor 24. Conveyor 24 moves the automobile body 28 through the drying tunnel 16, exposing the automobile body 28 to lamps 20 in a vacuum to dry and cure the paint.

When the automobile body 28 reaches the end of the drying tunnel 16, the exit air lock 18 is sealed from the ambient surrounding environment and pumped down using vacuum pump 32 to a pressure equal to the pressure within the drying tunnel 16. The exit lock 18 is opened to the drying tunnel 16 and the body 28 is transferred to the exit conveyor 26. The exit air lock 18 is then sealed from the drying tunnel 16 and vented to atmosphere through vent valve 36. When the pressure is equal to the ambient surrounding environment, the exit air lock 18 is opened to the ambient and the automobile body 28, painted and dried, is discharged from the vacuum drying apparatus 10. While the automobile body 28 is traversing the drying tunnel 16, the entry air lock 14 is isolated from the drying tunnel 16 and vented to atmosphere through vent valve 34. Once the pressure within the entry air lock 14 is equal to atmospheric, the entry air lock 14 is opened to the ambient to admit another automobile body 28. The process described above is then repeated, and the automobile bodies 28 are vacuum and heat dried in a continuous process. Note that drying takes place in both the entry air lock 14 and within the drying tunnel 16.

Figure 2:
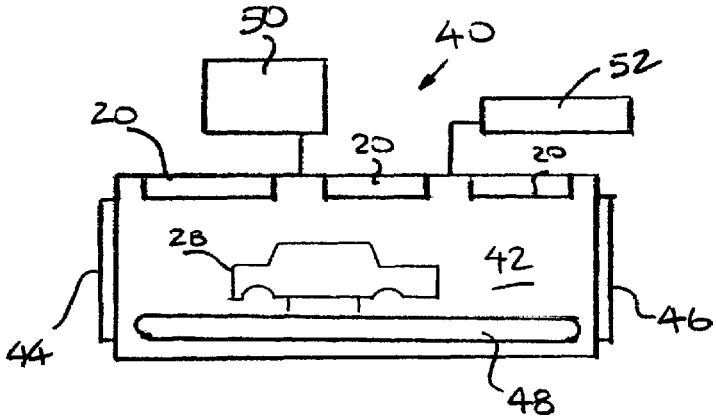
FIG. 2 is a schematic diagram illustrating the operation of a portion of the invention.

FIG. 2 shows another vacuum drying assembly 40 utilized in a batch mode drying operation. The vacuum drying assembly 40 includes a vacuum chamber 42 with doors 44 and 46 on either end. A conveyor 48 moves items such as automobile bodies 28, or other painted articles into and out of the chamber 42. The chamber 42 has radiant heat sources 20, a high capacity vacuum pump 50 and vent valve 52.

In operation, the chamber 42 is initially at atmospheric pressure with the door 44 opened to admit a freshly painted automobile body 28. The door 44 is then closed and the chamber 42 is pumped down by vacuum pump 50. The radiant heat sources 20 are turned on and the paint is dried to a desired level upon exposure to the heat and vacuum. When the drying is complete to the desired level, the chamber 42 is vented to atmosphere through vent valve 52. When the pressure within the chamber 42 is equal to atmospheric pressure, the door 46 is opened and the painted and dried automobile body 28 is removed from the chamber via conveyor 48.

This method and apparatus for drying and curing painted articles such as automobile bodies, is substantially cleaner as the disclosed inventive method provides an atmosphere substantially dust and particle free. Maintenance of the drying tunnel 16 and the air locks 14 and 18 is substantially less than that of a clean room type paint chamber. Further, the cycle time for curing painted articles within the drying chamber 16 is substantially shorter than current paint drying processes utilizing clean room drying tunnels, and therefore provides a faster drying time. Additionally, the disclosed inventive process provides an improved surface finish that results from the substantially particle free drying environment. Further, it should be understood that although paint is described in the disclosed example embodiment other coatings, such as primers, rust inhibitors, clear coats, and other substances applied to articles will benefit from the novel aspects of the disclosed inventive method and device.

While the invention has been described in connection with a preferred embodiment, it is not intended to limit the scope of the invention to the particular form set forth, but on the contrary, it is intended to cover such alternatives, modification, and equivalents as may be included within the spirit and scope of the invention as defined by the appended claims.

What is claimed is:

1. A method of drying paint applied to a painted automotive panel, comprising the steps of:

a) enclosing the painted automotive panel within an enclosure;

b) controlling a first pressure within the enclosure by drawing air from within the enclosure through a first outlet and preventing air from entering the enclosure through any other opening within the enclosure such that the first pressure within the enclosure is lower than a second pressure outside the enclosure; and c) maintaining the first pressure within the enclosure for a selected period to dry paint applied to the painted automotive panel.

2. The method as recited in claim 1, wherein said step of controlling a pressure within the enclosure includes generating a vacuum within the enclosure relative to a pressure outside of the enclosure and preventing air outside the enclosure from entering the enclosure.

3. The method as recited in claim 2, wherein the vacuum generated is maintained until the desired condition of the painted automotive panel is obtained.

4. The method as recited in claim 1, including the step of applying heat to the painted automotive panel while disposed within the enclosure at the first pressure.

5. The method as recited in claim 1, wherein the enclosure includes a tunnel portion and an air lock portion, wherein the tunnel portion is maintained at the first pressure, and a pressure within the air lock portion selectively changes between the first pressure and the second pressure.

6. The method as recited in claim 5, including the steps of placing the painted automotive panel within the air lock portion at the second pressure, reducing pressure within the air lock portion to the first pressure, and moving the painted automotive panel from the air lock portion to the tunnel portion.

* * * * *

UNITED STATES PATENT AND TRADEMARK OFFICE

CERTIFICATE OF CORRECTION

PATENT NO. : 7,658,017 B1
APPLICATION NO. : 10/755571
DATED : February 9, 2010
INVENTOR(S) : Laviolette et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1112 days.

Signed and Sealed this

Twenty-eighth Day of December, 2010

David J. Kappos

David J. Kappos
*Director of the United States Patent and Trademark Office*